United States Patent [19]

Collet

[11] 4,313,537

[45] Feb. 2, 1982

[54] DEVICE FOR HOLDING, DRYING AND REPETITIVELY DISPENSING A BAR OF SOAP

[76] Inventor: Theodore D. A. Collet, 6140 Calle Tuberia, Scottsdale, Ariz. 85251

[21] Appl. No.: 66,186

[22] Filed: Aug. 13, 1979

Related U.S. Application Data

[63] Continuation of Ser. No. 41,528, May 22, 1979.

[51] Int. Cl.[3] ..... A47K 5/08

[52] U.S. Cl. ..... 206/77.1; 248/314; 248/309 R

[58] Field of Search ..... 248/309 R, 314; 312/351; 232/65, 66, 64; 206/77.1

[56] References Cited

U.S. PATENT DOCUMENTS

| | | | |
|---|---|---|---|
| 211,131 | 1/1879 | Bruce | 232/66 |
| 1,144,526 | 6/1915 | Briant | 232/66 |
| 1,242,739 | 10/1917 | Tappan | 232/66 |
| 1,872,816 | 8/1932 | Ringland | 206/77.1 |
| 2,596,675 | 5/1952 | Giossi | 206/77.1 |
| 2,879,622 | 3/1959 | Graziano | 206/77.1 |
| 3,054,211 | 9/1962 | Hawk et al. | 312/351 X |

*Primary Examiner*—William H. Schultz
*Attorney, Agent, or Firm*—Warren F. B. Lindsley

[57] ABSTRACT

A device for repetitively dispensing the same bar of soap comprising an elongated trough for receiving at its upper end a bar of soap wherein the trough is formed by two relatively thin elongated members spacedly arranged with one of the members being pivotally mounted relative to the other for engaging the other member at their common ends to hold the bar of soap therein. The horizontal component of the mass of the bar of soap is applied to the one of the members and the vertical component of the mass of the bar of soap is applied to the other of the members.

8 Claims, 10 Drawing Figures

DEVICE FOR HOLDING, DRYING AND REPETITIVELY DISPENSING A BAR OF SOAP

BACKGROUND OF THE INVENTION

This application is a continuation of application Ser. No. 41,528 filed May 22, 1979 and entitled Device for Holding, Drying and Repetitively Dispensing a Bar of Soap.

This invention relates to holding and dispensing devices for soap products and more particularly to devices for holding, drying and repetitively dispensing a bar of soap during its eroding "life span".

Although soap dishes, trays and the like have been used in kitchens, bathrooms, shower rooms and stalls, all of these devices have the same problems, namely the difficulty of repetitively retrieving a bar of soap in a dry and easy to handle condition. Most soap dishes and trays hold water so that the bar of soap erodes away during the time it is in the dish or tray. Those soap dishes and trays that have drain holes are not readily useable when part of a shower room or stall.

DESCRIPTION OF THE PRIOR ART

Heretofore the only soap retrievable device known for use particularly in showers is the soap dish or tray which either attaches to or is molded into the associated tile wall. Since these soap dishes are usually wet thereby eroding the soap and additionally are difficult to retrieve a bar of soap therefrom without adding further moisture to the soap dish, a new soap holding, drying and retrieving device is desirable.

SUMMARY OF THE INVENTION

In accordance with the invention claimed a new and improved device is provided for holding, drying and repetitively dispensing a given bar of soap effectively regardless of its changing size.

It is, therefore, one object of this invention to provide a new and improved soap holding, drying and dispensing device for bar soap.

Another object of this invention is to provide a new and improved dispenser for repetitively holding, drying and dispensing the same bar of soap during its "life span".

A further object of this invention is to provide a new and improved dispensing device for bars of soap which may be used in retrieving repetitively the same bar of soap without getting the dispensing device wet by the hands of the retriever.

A still further object of this invention is to provide an improved repetitively useable holding and dispensing device for a bar of soap which is wall mounted in a shower stall and drains water from the surface of the bar of soap onto the floor of the shower stall.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
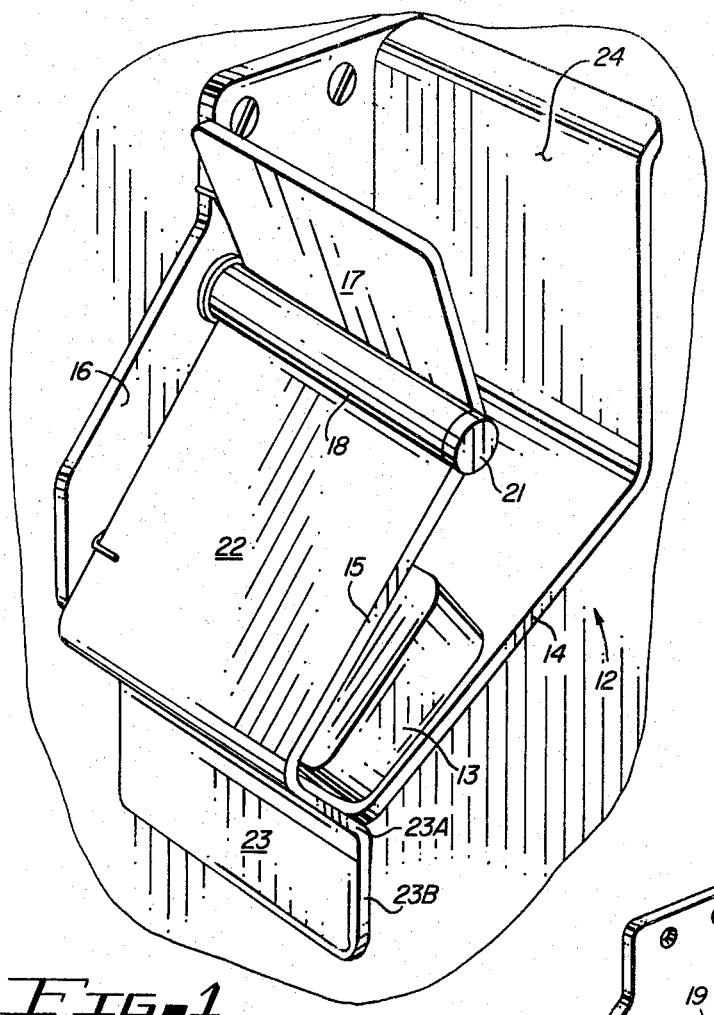
FIG. 1 is a perspective view of a holding, drying and repetitively operable dispensing device for a bar of soap and embodying the invention.

Referring more particularly to the drawing by characters of reference, FIGS. 1–4 discloses a device 12 for holding, drying and repetitively dispensing a bar of soap 13. The device comprises a pair of juxtapositioned members 14 and 15 which are suitably attached to or formed as a part of a bracket like supporting member 16.

Although member 14 may be fixedly attached to or formed as a molded part of support member 16, member 15 must be pivotally attached to support member 16 so as to function in accordance with the teaching of this invention.

Figure 4:
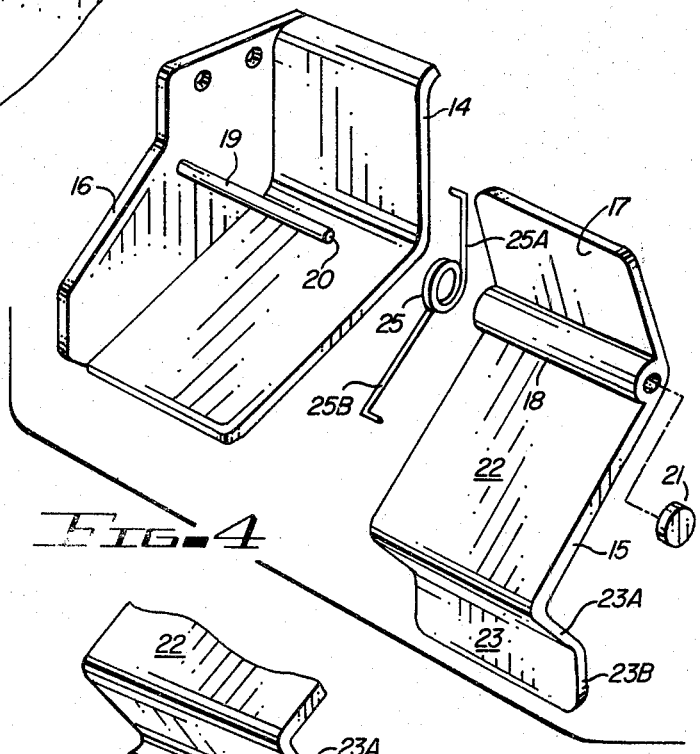
FIG. 4 is an exploded perspective view of the device shown in FIG. 1.

As shown in FIG. 4, member 15 is formed in an elongated distorted flat configuration having at a point spaced from its end 17 a cylindrical housing 18 for journaling a rod 19 which is fixedly attached to supporting member 16. The free end of rod 19 may be provided with an external thread 20 to which an internally threaded ring or cap 21 may be secured when the housing 18 is mounted around and forms a journal for rod 19 in the assembled form shown in FIG. 1.

Figure 3:
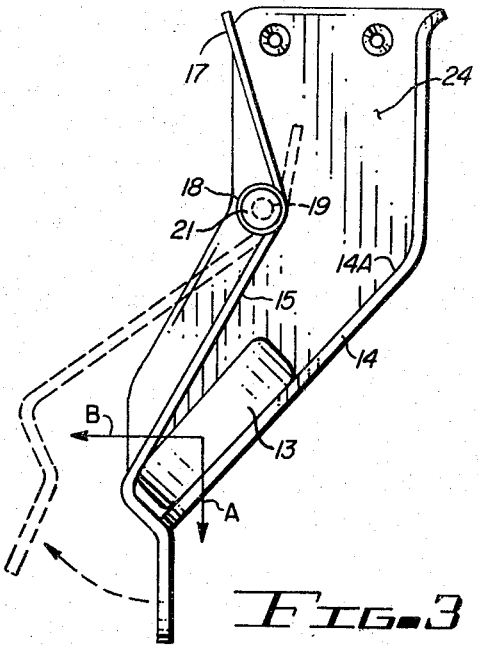
FIG. 3 is a front view of FIG. 1 and showing in dash lines the soap releasing member in its soap dispensing position.
Figure 2:
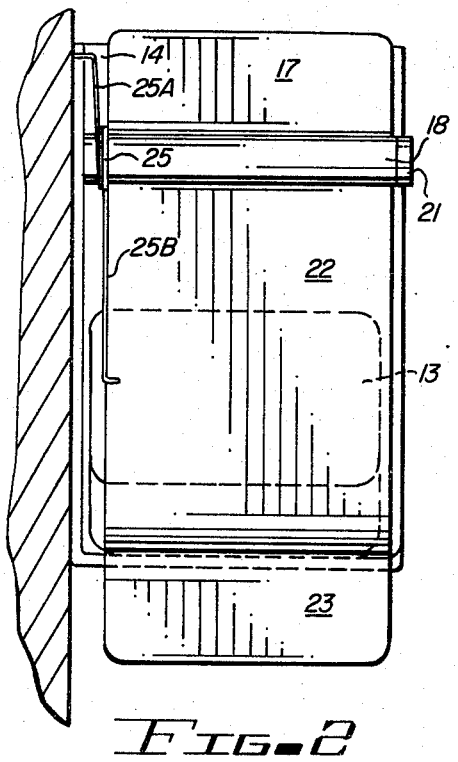
FIG. 2 is a left end view of the device shown in FIG. 1.

FIGS. 1, 3 and 4 illustrate that member 15 comprises a center portion 22 having ends 17 and 23 extending laterally therefrom in different directions.

Portion 23 comprises two parts 23A and 23B. Part 23A extends substantially perpendicular to portion 22 of member 15 and part 23B extends laterally from the free end of part 23A in such a manner that it may be readily bumped by the hand of a user in the manner shown in dash lines in FIG. 3 to pivotally move end portion 23 away from member 14. This action permits the bar of soap 13 to move under the weight of gravity and slide off of the surface of member 14 and into the hand of the user that pivotally moved member 15 away from member 14.

As noted from FIGS. 1 and 3 of the drawing, the vertical component A of the weight of the bar of soap extends through the stationary member 14 with the horizontal component B of the weight or mass of this bar of soap extending to and through the moveable member 15. It should be noted that an oblique component of the mass of the bar of soap applied to the movable member 15 being substantially parallel to the surface of the fixed member 14 develops a slight torque on movable member 15 about its pivotal mounting. Thus, most of its weight is absorbed by the stationary member 14 with very little force being applied to the pivotally movable member 15. Accordingly, the weight of member 15 may absorb the horizontal component of the force of gravity on the bar of soap without moving under the torque or horizontal component of gravity on the bar of soap.

In order to assure no movement of the bar of soap off of the inside surface 14A of member 14 even if it is dropped into the space between members 14 and 15 through the funnel shaped opening 24, a leaf spring or other suitable biasing means 25 is mounted around rod 19 with one end 25A attached to support member 16 and the other end 25B attached to member 15 so as to bias member 15 in a counterclockwise direction, as shown in FIGS. 1 and 3, toward stationary member 14.

Figure 5:
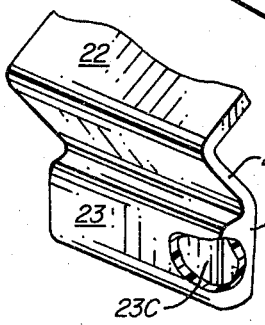
FIG. 5 is a perspective view of a modification of the lower end of the soap releasing member showing a weighted end.
Figure 6:
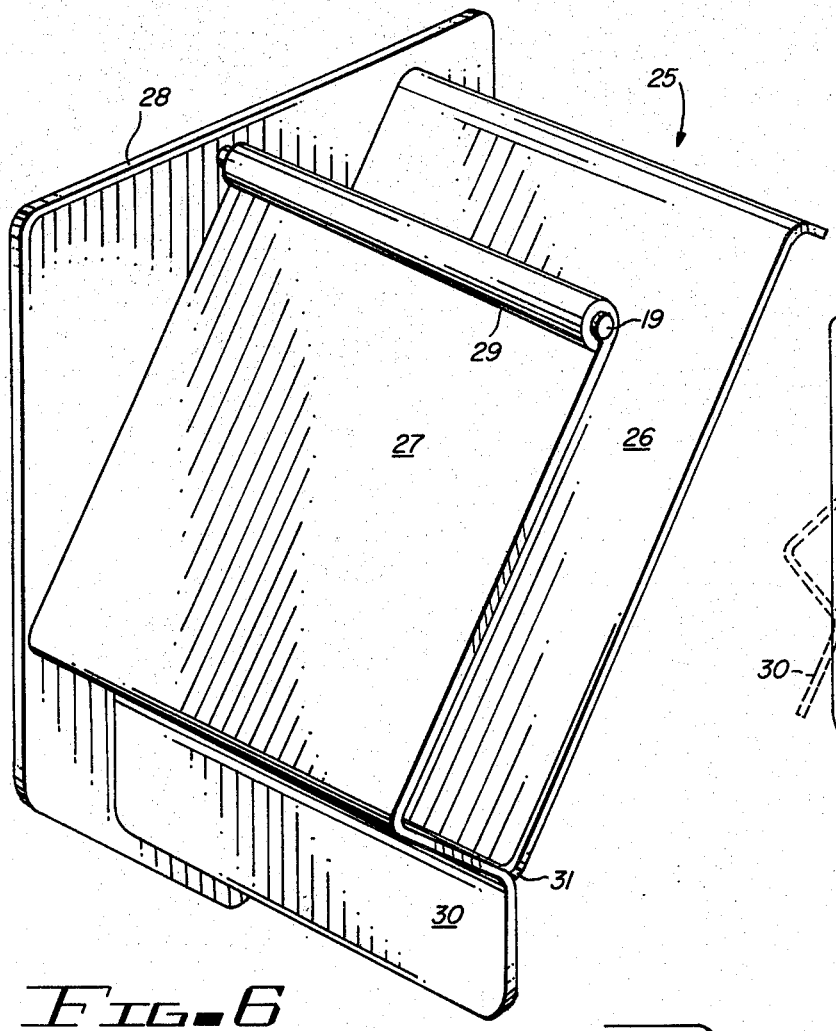
FIG. 6 is a perspective view of a further modification of the soap holding, drying and dispensing device shown in FIG. 1.

FIG. 5 illustrates that the end 23B of portion 23 may be hollow with a suitable weight 25 arranged therein. This weight provides the necessary torque in a counterclockwise direction toward stationary member 14 thereby eliminating the need for spring 25 if some form of bias other than the weight of member 15 is needed to cause engagement of members 14 and 15 as shown in FIGS. 1 and 3.

It should be noted that even though members 14 and 15 are in engagement with each other at their lower ends to keep the bar of soap between them, nevertheless any water or moisture on the soap may drain off of the soap and run down the surface of part 23B of portion 23 dropping to the floor of the shower room. This feature permits the bar of soap to dry off each time it is placed back in the dispenser.

To retrieve the bar of soap from the dispenser, it is merely necessary to bump the hand of user against the lower end of part 23A or portion 23 of member 15 and pivotally moving it clockwise as shown in dash line in FIG. 3. This action causes the bar of soap to slip off of the sloping surface of member 14 into the hand of the user. After it has been used the bar of soap is again dropped through the funnel shaped opening 24 between member 14 and 15 where it comes to rest in the position shown ready for its next use.

FIGS. 6–10 disclose a further modification of the bar of soap dispenser shown in FIGS. 1–5 wherein the bar of soap holding, drying and dispensing device 25 comprises two juxtapositioned members 26 and 27 secured to a wall mountable supporting bracket 28. Member 26 is fixed to or formed integral with bracket 28 and extends laterally thereof in the manner of device 12 shown in FIG. 1. Member 27 is similar to member 15 of FIG. 1 except that its end 29 is curved back on itself to form a journal for rod 19, one end of which is fixedly secured to support bracket 28. In this modification member 27 under the action of gravity pivotally rotates about rod 19 until the lower end of the angularly deformed portion 30 thereof engages the lower free end 31 of member 26.

Figure 7:
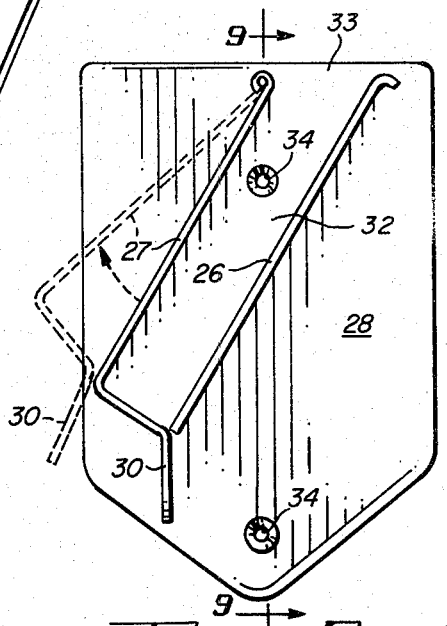
FIG. 7 is a front view of FIG. 6 showing in dash lines the soap releasing member in its soap dispensing position.
Figure 8:
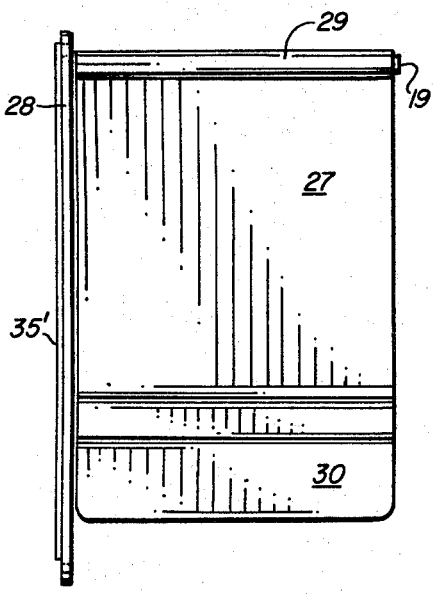
FIG. 8 is a left end view of the device shown in FIG. 6.

FIG. 7 illustrates in detail in a similar manner to the illustration shown in FIG. 3 the cooperation of members 26 and 27 to form a trough 32 for receiving through its opening 33 a bar of soap in the manner illustrated in FIGS. 1 and 3.

Figure 9:
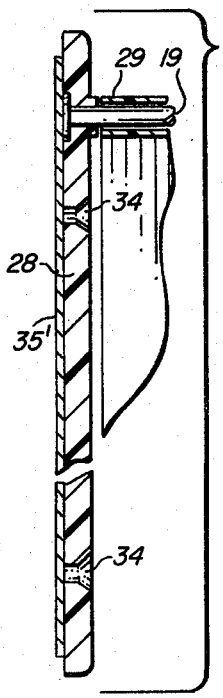
FIG. 9 is a cross sectional view of FIG. 7 taken along the line 9—9.
Figure 10:
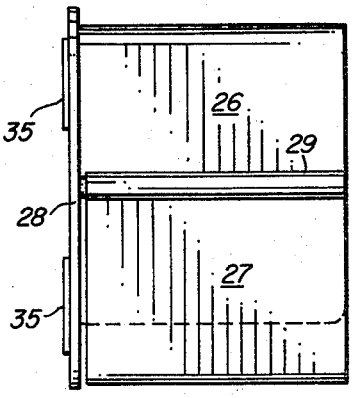
FIG. 10 is a top view of FIG. 6.

FIGS. 7 and 9 illustrate that the bracket 28 may be bolted to a supporting wall with through bolt holes 34, but the device 25 may also be held against a supporting wall 35' by the application of a suitable adhesive or by means of suction cups 35 as shown in FIG. 10.

Although but a few embodiments of the present invention have been illustrated and described, it will be apparent to those skilled in the art that various changes and modifications may be made therein without departing from the spirit of the invention or from the scope of the appended claims.

What is claimed is:

1. A device for repetitively dispensing the same bar of soap comprising:

a support, a pair of relatively thin elongated members spacedly arranged to extend laterally from said support member to define between them an elongated trough for receiving at its upper end the bar of soap, one of said members being pivotally mounted relative to said other member on said support for engaging said other member at their common other ends to hold the bar of soap in said trough, whereby when a bar of soap is in said trough, an oblique component of its mass is applied to said one of said members substantially parallel to the surface of the other of said members developing a slight torque on said one of said members about its pivotal mounting, the other of said members being fixed, positioned below said one of said members and supporting said bar of soap, and means forming a part of said other end of said one of said members for engagement by a user for pivoting it away from said other member to cause the bar of soap in said trough to be dislodged and fall into the hand of the user.

2. The device set forth in claim 1 wherein:

said pair of members form a funnel shaped opening at its upper end for readily receiving the bar of soap.

3. The device set forth in claim 1 wherein:

said one of said members is bent laterally of its longitudinal axis adjacent the area of engagement with said other of said members to provide a relatively flat surface for the bar of soap to engage within said trough.

4. The device set forth in claim 1 wherein:

said one of said members is biased into engagement with said other of said members.

5. The device set forth in claim 4 wherein:

said one of said members is spring biased into engagement with said other of said members.

6. The device set forth in claim 1 wherein:

said support is provided with a pin extending laterally thereof, and said one of said members is journaled on said pin to rotate therearound.

7. The device set forth in claim 6 wherein:

the end of said members at said funnel shaped upper end is turned over on its end to form a journal for said one of said members.

8. The device set forth in claim 1 wherein:

said other end of said one of said members is weighted to aid in biasing it against said other of said members.

* * * * *